United States Patent [19]

Cohen

[11] Patent Number: 4,611,437

[45] Date of Patent: Sep. 16, 1986

[54] SHARPENING SYSTEM AND RELATED METHOD

[76] Inventor: Morton Cohen, 41-27 Westmoreland St., Little Neck, N.Y. 11363

[21] Appl. No.: 637,854

[22] Filed: Aug. 6, 1984

[51] Int. Cl.[4] ..... B24B 3/54

[52] U.S. Cl. ..... 51/181 R; 51/204; 76/82

[58] Field of Search ..... 51/181 R, 204, 211, 51/212, 214, 156–158, 285; 76/82, 84

[56] References Cited

U.S. PATENT DOCUMENTS

| | | | |
|---|---|---|---|
| 478,608 | 7/1892 | Keist | 51/181 |
| 819,735 | 5/1906 | Cruce | 51/211 R |
| 1,959,647 | 5/1934 | Stivers | 51/211 R |
| 2,018,985 | 10/1935 | Walsh | 51/212 |
| 3,254,630 | 6/1966 | Tufan | 51/181 |
| 3,623,280 | 11/1971 | Chesnut | 51/211 R |
| 4,197,677 | 4/1980 | Graves | 51/214 R |

FOREIGN PATENT DOCUMENTS

| | | | |
|---|---|---|---|
| 0280595 | 1/1952 | Switzerland | 51/211 R |

*Primary Examiner*—Frederick R. Schmidt
*Assistant Examiner*—Robert A. Rose
*Attorney, Agent, or Firm*—Roberts, Spiecens & Cohen

[57] ABSTRACT

A sharpening system is formed of a plurality of spaced, elongated, cylindrical sharpening rods formed of aluminum oxide embedded in ceramic. The rods are positioned in an open framework in parallel relationship. The rods are held at opposite ends by polygonal plates with the rods being supported at the apices of the polygons. A tightening rod is provided which holds the plates together and which permits the sharpening rods to be fixed in position or loosened for rotation when necessary.

7 Claims, 12 Drawing Figures

SHARPENING SYSTEM AND RELATED METHOD

FIELD OF INVENTION

This invention relates to sharpening systems and to methods appertaining thereto.

BACKGROUND

Various sharpening systems are known in which sharpening surfaces are applied to the cutting edges of cutting instruments for sharpening the same. Some of these devices are shown, for example, in U.S. Pat. Nos. 317,591; 961,010; 1,389,534; 1,708,006; 2,191,899; 2,380,539; 2,896,482; and 4,441,279.

T. W. Stone reveals in U.S. Pat. No. 317,591 a sharpening apparatus consisting of a bar of metal tapering from a center towards two free ends and having a rough or abrasive surface on one half and a smooth surface on the other half.

P. J. Poitras et al reveal in U.S. Pat. No. 961,010 a sharpening device including an adjustable blade holding vice associated with a stone holder for purposes of holding the same so that the abrasive member may be operated at a variety of angles corresponding with the cutting edge of the instrument being sharpened.

E. J. Sawtelle shows in U.S. Pat. No. 1,389,534 a honing device comprising a flat supporting body on the opposite faces of which are mounted thin plates of metal constituting sharpening elements.

In U.S. Pat. No. 1,708,006, J. O. Aske reveals a sharpening stone box including upper and lower sections hingedly connected and permitting the hinged attachment of a sharpening stone such that the stone can be moved with either of the hingedly connected sections.

A. Primak shows in U.S. Pat. No. 2,191,899 a manually operated sharpening device including a clamp for the implements to be sharpened, a feed screw extending in spaced parallel relation to the clamp, a traveling nut on the feed screw, a guide rod rockably secured to the nut, and an abrading member reciprocally mounted on the guide rod.

In U.S. Pat. No. 2,380,539 B. M. Miller reveals a sharpening device including a body of rod-like form having four longitudinal grooves therein and a mass containing silicon carbide or other suitable abrasives bonded to the surface of each of the grooves. The granular size of the abrasives in two of the grooves is greater than the granular size of the abrasives in the other two grooves. The surface of the masses project beyond the surface of the rod-like body.

In U.S. Pat. No. 2,896,482 is shown a sharpener device provided with a bevel-defining mechanism including opposed sharpener ribs mounted substantially radially and with relative angular adjustment with respect to the axis of a handle and rod such that sharpening can be carried out by drawing a blade edge through the bevel-defining device and then stroking the opposite bevel faces of the blade edge in turn across the honing rod.

Nelson Storm et al show in U.S. Pat. No. 4,441,279 a portable blade sharpening device including a vice to grip the blade and a guide bracket attached to the device and a tool having a guide rod cooperating with the guide bracket to bevel the blade to be sharpened.

SUMMARY OF INVENTION

It is an object of the invention to provide an improved sharpening system.

It is another object of the invention to provide a sharpening system and related method which constitute improvements on sharpening devices of the above-noted types.

Yet another object of the invention is to provide an improved sharpening system offering a plurality of sharpening surfaces which are individually adjustable.

It is still another object of the invention to provide an improved sharpening system in which the sharpening members together with supporting members constitute a framework by means of which the sharpening members can be manipulated.

Still another object of the invention is to provide an improved sharpening system which offers excellent characteristics with respect to sharpening instruments for cutting objects with hard/smooth surfaces and relatively pulpy insides.

Still another object of the invention is to provide for the convenient projection of different sharpening surfaces without the need for dismantling or realigning any assemblage of parts.

Yet another object of the invention is to provide an improved sharpening system wherein the need for a wetting fluid such as oil or water is avoided.

Still another object of the invention is to provide an improved sharpening system wherein a fresh cutting surface can be made available in a relatively simple manner.

It is still a further object of the invention to provide an improved sharpening system employing a plurality of sharpening rods wherein each rod may be easily cleaned with scouring powder and water to renew and refresh the same.

Yet another object of the invention is to provide an improved sharpening system suitable for use upon the cutting edges of blades having other than straight edges.

In achieving the above and other of the objects, features and advantages of the invention, there is provided generally a sharpening system comprising a plurality of spaced sharpening rods with a holding arrangement being provided to hold the rods in parallel relationship. These rods are preferably of different sharpening power. For example, they may be formed of a ceramic and may include respectively different amounts of abrasives. The abrasive may preferably be, by way of example, particulate aluminum oxide.

In accordance with the preferred embodiment of the invention, the holding arrangement preferably includes plates at opposite ends of the rods. These plates will advantageously support the rods at the apices of a polygon. The plates are similarly of like polygonal shape. These plates are provided, as will be shown hereinbelow, with recesses to receive the ends of the rods.

In accordance with the preferred version of the invention, a tightening arrangement such as a tightening rod will be employed to connect the plates to lock the sharpening rods therein. The tightening rod may preferably be located centrally of the plates and will extend therebetween. On the tightening rod will be provided a tightening device for selectively tightening and loosening the tightening rod. The sharpening rods are fixed in position when the tightening device is tightened and are rotatable in position when the tightening device is loosened.

As will be shown hereinbelow, the rods are held preferably in open framework relationship. The rods are moreover preferably of elongated, cylindrical form. The recesses receiving the rods are preferably of truncated blind bore form with the rods protruding therefrom in radial direction. These plates, may for example, be of wood, plastic, metal or rubber. Advantageously, one of the rods may include substantially no abrasives.

In another form of the invention, there is provided a support which holds the aforesaid holding arrangement and rods for rotation on an axis of symmetry in the manner of a ferris wheel.

The invention also contemplates a method wherein rods are supported in spaced parallel relationship in which the rods are selectively and individually rotatable. These rods are provided, as has been noted above and as will be described in greater detail hereinbelow, with different sharpening power.

The above objects, features and advantages of the invention, will be described below in conjunction with the associated drawing.

DETAILED DESCRIPTION

Figure 1:
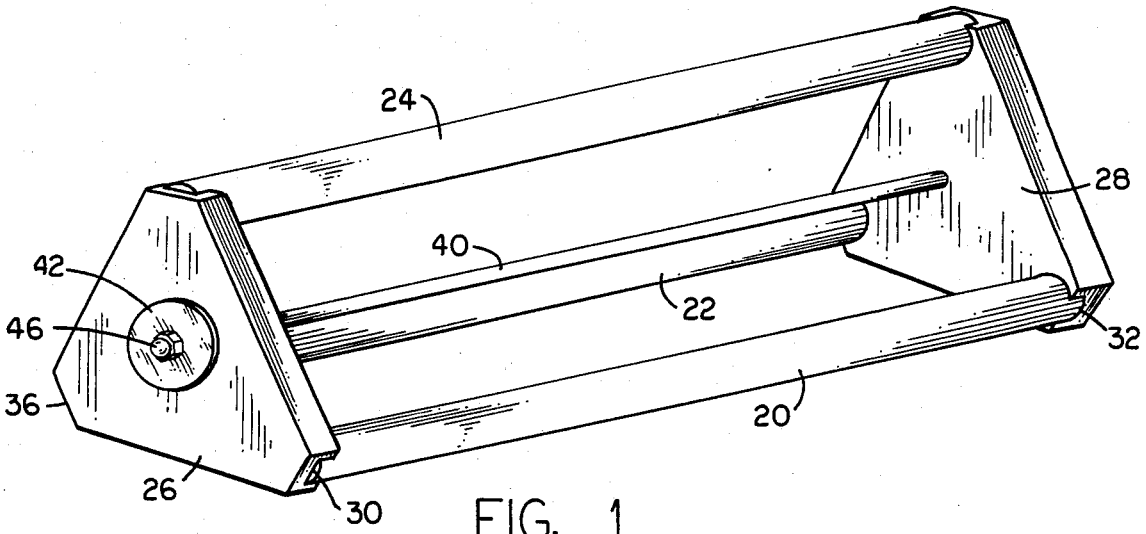
FIG. 1 is a perspective view of a sharpening system provided in accordance with a preferred embodiment of the invention.
Figure 2:
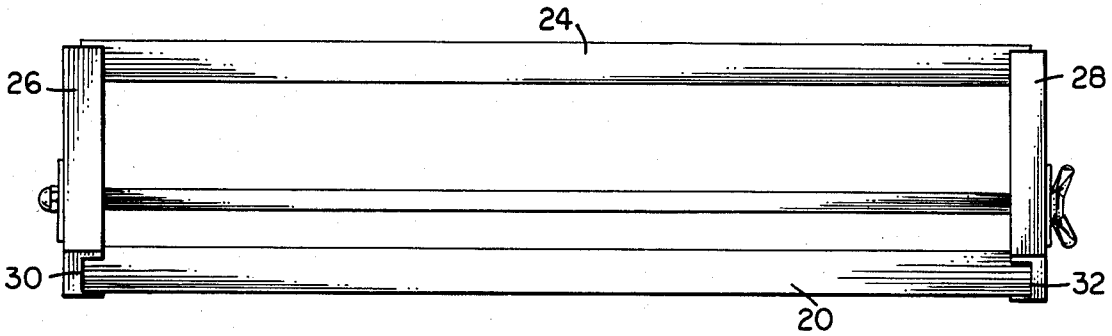
FIG. 2 is a side view of the sharpening system of FIG. 1.

The sharpening system illustrated in FIGS. 1–4 includes a plurality of spaced and parallel sharpening rods such as indicated at 20, 22 and 24. These sharpening rods are commercially procurable and are formed, for example, of a ceramic in which aluminum oxide is embedded. While such a selection of components is to be preferred, it is to be understood that other sharpening rods are readily substitutable for the aforedescribed rods provided that the same functions are performed as may be described hereinbelow.

It is to be noted that each of the rods 20, 22 and 24 is of a respectively different sharpening power. To this end, the rods may consist of different proportions of abrasives. For example, in the case where the three rods 20, 22 and 24 are each capable of performing a sharpening function, the rod 20 may be the rod which has the maximum amount of abrasive, the rod 22 may have 50 percent of the amount of abrasive in rod 20 and the rod 24 may have 10 percent of the amount of abrasive which is incorporated into rod 20.

In a further embodiment of the invention, one of the rods may preferably be provided with no abrasive at all and such a rod may be additional to those indicated in FIGS. 1–4 or may be in substitution of one of these rods. This rod having no abrasive therein may be used for purposes of burnishing and to give the edge being sharpened a fine finish free from burrs. It is to be noted, of course, that additional rods may be added to the system, inclusive of a coarser abrasive or inclusive of greater amounts of abrasive or an amount abrasive intermediate that indicated above.

The aforesaid rods are held in parallel relationship in an open framework system. The ends of the rods are accommodated in blind bores provided in supporting plates 26 and 28. One such blind bore is indicated at 30 and another at 32. The plates are generally of polygonal shape such as the triangle indicated in FIGS. 1–4. The plates support the rods 20, 22 and 24 at the apices of a polygonal form or configuration.

Figure 3:
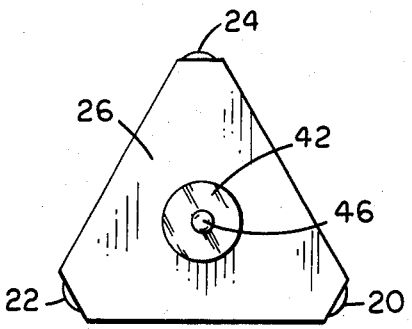
FIG. 3 is an end view of the sharpening system of FIGS. 1 and 2.
Figure 4:
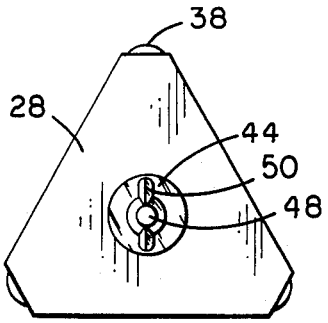
FIG. 4 is an opposite end of view of the sharpening system.

In the illustrated embodiment, the apices of the triangular plates 26 and 28 are truncated as indicated, for example, at 36. This in turn truncates the blind bores 30 and 32 and the like. This truncation enables the rods 20, 22 and 24 to protrude radially from the blind bores as best seen in FIGS. 3 and 4, at for example, 38.

The plates 26 and 28 are connected together by means of a tightening rod 40 centrally located with respect to plates 26 and 28 and extending therethrough. The rod 40 includes a shoulder (not shown) at each end thereof for the plates 26 and 28 to abut against. The plates 26 and 28 are sandwiched between these shoulders and the washers 42 and 44. At one end of the rod 40 is positioned a head 46 which traps the washer 42 against plate 28. At the other end of the rod, is a threaded configuration 48 which is engaged by a wing nut 50 to trap the washer 44 against the plate 28. When the device is intended for operation, the tightening system is tightened through turning of the wing nut 50. This holds the rods 20, 22 and 24 firmly in position and militates against the rotation thereof. After extended use, when sharpening residue tends to accumulate on the respective rods, or when it is desired to bring a fresh portion of such rods into operative position protruding as indicated at 38, the tightening system is loosened and the rods 20, 22 and 24 are individually rotated to bring a fresh portion of the respective rods to operating position. Thereafter the tightening system is tightened and the rods are once again held in rather rigorous manner to prevent the rotation of the same.

In the aforegoing arrangement, the plates may be made of wood, plastic, metal or rubber or the like. When made of plastic the plates, for example, may be injection molded or formed in any other suitable manner. If made of metal the plates, for example, may be machined or cast. The hardware employed in the aforegoing system made be made of any suitable material such as metal or plastic or suitable compositions.

Figure 5:
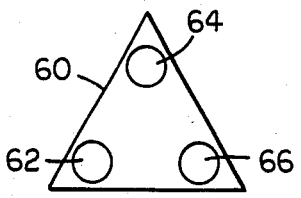
FIG. 5 diagrammatically illustrates another embodiment of the invention.

Other forms which the invention may take are shown in FIGS. 5–11. In FIG. 5 is shown a triangular end plate 60 in which rods 62, 64 and 66 are located at the apices of the indicated polygon. In this case the rods are wholly contained within the outer perimetry of the polygon and do not protrude radially therefrom.

Figure 6:
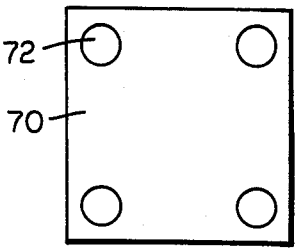
FIG. 6 diagrammatically illustrates still another embodiment of the invention.
Figure 7:
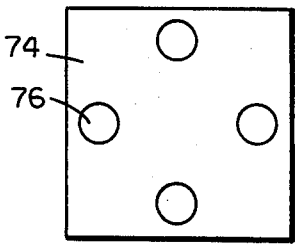
FIG. 7 diagrammatically illustrates yet another embodiment of the invention.
Figure 8:
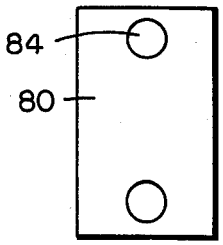
FIG. 8 shows in diagrammatic form still another embodiment of the invention.
Figure 9:
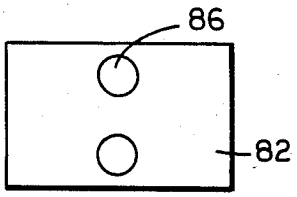
FIG. 9 diagrammatically illustrates a further embodiment of the invention.

In FIG. 6 the end plates 70 are formed as quadrilaterals or squares with the rods 72 being embodied at the apices thereof. In FIG. 7 the end plates are also of square or quadrilateral form and are indicated at 74. In this case therods 76 are not located at the apices but are located adjacent the sides of the quadrilateral. In FIGS. 8 and 9 the end plates 80 and 82 are of rectangular form with the rods 84 and 86 being respectively located at a position adjacent the shorter and longer ends of the rectangles respectively.

Figure 10:
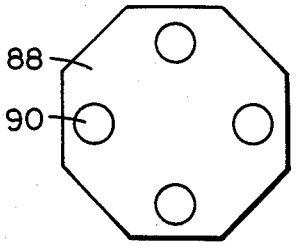
FIG. 10 illustrates yet another embodiment of the invention.
Figure 11:
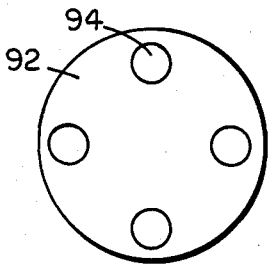
FIG. 11 illustrates still another embodiment of the invention.

FIG. 10 illustrates end plates 88 of octagonal form with the rods 90 being located adjacent alternate edges of the octagon. FIG. 11 shows circular end plates 92 with rods 94 being located in respective quadrants thereof.

Figure 12:
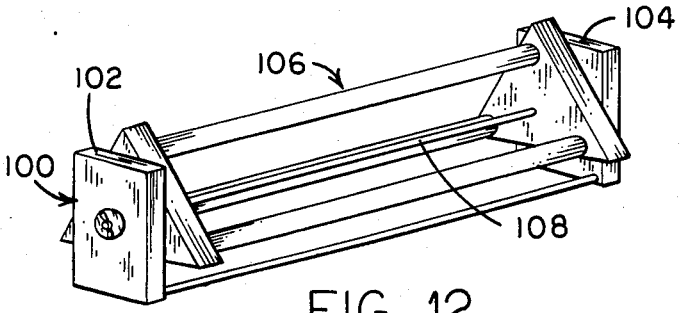
FIG. 12 illustrates a further form which the invention may take, wherein a sharpening system which is generally similar to that of FIG. 1 is held in a cradle for rotation.

FIG. 12 illustrates a further embodiment of the invention in which there is provided a cradle 100. The cradle 100 includes bracket arms 102 and 104 between which is located sharpening system 106 which may take one of the forms indicated above. In this case the sharpening system may be rotated within the cradle very much in the manner of a ferris wheel, to bring the respective rods into operational position.

The invention also contemplates the provision of a method which may be generally considered to be the supporting of rods of different sharpening power in spaced parallel relationship, in which the rods are selectively and individually rotatable. As has been noted above, the rods are individually rotated to bring fresh portions thereof into exposed sharpening position for the reasons which have already been indicated. With respect to FIG. 12 it will be noted that the system is supported for rotation on an axis of symmetry indicated generally at 108.

There will now be obvious to those skilled in the art many modifications and variations of the system and method set forth hereinabove. These modifications and variations will not depart from the scope of the invention if defined by the following claims.

What is claimed is:

1. A sharpening system comprising a plurality of spaced rods and holding means to hold said rods in parallel relation, said rods being of different sharpening powers, said holding means including plates at opposite ends of the rods, one of said rods functioning or a tightening rod connecting the plates to lock the rods herein, the tightening rod being located centrally of the plates and extending therebetween, the rods being held in open framework relation by said plates, said rods being spaced apart from each other and from said tightening rod at substantial distances and exposing said tightening rod, the plates being provided with recesses to receive the ends of the rods, the recesses being truncated blind bores wherefrom the rods protrude outwardly in radial direction and protrude radially outwardly with respect to said tightening rod and beyond the plates thereby exposing the rods along the entire lengths thereof at positions external of said plates, and tightening means for selectively tightening and loosening the tightening rod, said rods being fixed in position when the tightening means is tightened and rotatable in position when the tightening means is loosened, one of said rods being a burnishing rod, the rest of said rods being sharpening rods of ceramic and including respectively different amounts of abrasive.

2. A sharpening system as claimed in claim 1 wherein the abrasive is particulate aluminum oxide.

3. A sharpening system as claimed in claim 1 wherein the plates support the sharpening rods at the apices of a polygon.

4. A sharpening system as claimed in claim 1 wherein the plates are of like polygonal shape.

5. A sharpening system as claimed in claim 1 wherein the rods are of elongated cylindrical form.

6. A sharpening system as claimed in claim 1 wherein one of said sharpening rods includes substantially no abrasive.

7. A sharpening system as claimed in claim 1 comprising support means for holding the holding means and sharpening rods for rotation on an axis of symmetry.

* * * * *